US006656657B2

(12) United States Patent
Patel et al.

(10) Patent No.: US 6,656,657 B2
(45) Date of Patent: Dec. 2, 2003

(54) TONER PROCESSES

(75) Inventors: Raj D. Patel, Oakville (CA); Michael A. Hopper, Toronto (CA); Joseph Bartel, Toronto (CA); Edward G. Zwartz, Mississauga (CA)

(73) Assignee: Xerox Corporation, Stamford, CT (US)

( * ) Notice: Subject to any disclaimer, the term of this patent is extended or adjusted under 35 U.S.C. 154(b) by 93 days.

(21) Appl. No.: 10/106,078

(22) Filed: Mar. 25, 2002

(65) Prior Publication Data

US 2003/0180647 A1 Sep. 25, 2003

(51) Int. Cl.[7] ..... G03G 5/00
(52) U.S. Cl. ..... 430/137.14
(58) Field of Search ..... 430/137.14

(56) References Cited

U.S. PATENT DOCUMENTS

| | | | | |
|---|---|---|---|---|
| 4,517,268 | A | 5/1985 | Gruber et al. | 430/39 |
| 4,758,506 | A | 7/1988 | Lok et al. | 430/903 |
| 4,859,550 | A | 8/1989 | Gruber et al. | 430/39 |
| 5,034,298 | A | 7/1991 | Berkes et al. | 430/110 |
| 5,278,020 | A | 1/1994 | Grushkin et al. | 430/137 |
| 5,290,654 | A | 3/1994 | Sacripante et al. | 430/137 |
| 5,308,734 | A | 5/1994 | Sacripante et al. | 430/137 |
| 5,344,738 | A | 9/1994 | Kmiecik-Lawrynowicz et al. | 430/137 |
| 5,370,963 | A | 12/1994 | Patel et al. | 430/137 |
| 5,510,221 | A | 4/1996 | Matalevich et al. | 430/106.6 |
| 5,780,190 | A | 7/1998 | Listigovers et al. | 430/39 |
| 5,914,209 | A | 6/1999 | Grushkin | 430/106.6 |
| 5,925,488 | A | 7/1999 | Patel et al. | 430/137 |
| 5,977,210 | A | 11/1999 | Patel et al. | 523/161 |
| 5,994,020 | A | 11/1999 | Patel et al. | 430/137 |
| 6,132,924 | A | 10/2000 | Patel et al. | 430/137 |
| 6,268,102 | B1 | 7/2001 | Hopper et al. | 430/137.14 |

OTHER PUBLICATIONS

Copending Application Ser. No. 09/877,747, filed Jun. 11, 2001, on "Toner Coagulant Processes" by Lu Jiang et al.
Copending Application Ser. No. 09/922,263, filed Aug. 16, 2001, on "Toner Coagulant Processes" by Raj D. Patel et al.
Copending Application Ser. No. 09/810,138, filed Mar. 19, 2001 on "Toner Coagulant Processes" by Michael A. Hopper et al.
Copending Application Ser. No. 10/062,129, filed Feb. 4, 2002 on "Toner Processes" by Lu Jiang et al.
Copending Application Ser. No. 09/976,943, filed Oct. 15, 2001 on "Toner Coagulant Processes" by Daryl Vanbesien et al.

*Primary Examiner*—Mark A. Chapman
(74) *Attorney, Agent, or Firm*—E. D. Palazzo

(57) ABSTRACT

A toner process comprising mixing an acidified dispersion of an acicular magnetite with an anionic latex, an anionic carbon black dispersion, and an anionic wax dispersion.

39 Claims, No Drawings

TONER PROCESSES

RELATED APPLICATIONS

Illustrated in application U.S. Ser. No. 10/106,512 on Toner Processes, the disclosure of which is totally incorporated herein by reference, is a process comprising heating an acidified dispersion of an acicular magnetite, a carbon black colorant dispersion, an optional wax dispersion, and an acicular latex.

Illustrated in application U.S. Ser. No. 10/106,473 on Toner Processes, filed concurrently herewith, the disclosure of which is totally incorporated herein by reference, is a toner process for the preparation of a toner comprising mixing a colorant dispersion comprising an acicular magnetite dispersion and a carbon black dispersion with a latex, a wax dispersion and a coagulant.

Illustrated in application Ser. No. 10/086,063 on Toner Processes, the disclosure of which is totally incorporated herein by reference, is a process comprising heating a latex, a colorant dispersion, a polytetrafluoroethylene dispersion, and an organo metallic complexing component.

Illustrated in application U.S. Ser. No. 10/106,520 on Toner Coagulant Processes, the disclosure of which is totally incorporated herein by reference, is a process for the preparation of toner comprising (i) generating or providing a latex emulsion containing resin, water, and an ionic surfactant, and generating or providing a colorant dispersion containing colorant, water, and an ionic surfactant, or a nonionic surfactant;

(ii) blending the latex emulsion with the colorant dispersion;

(iii) adding to the resulting blend a coagulant of a polyamine salt of an acid wherein the salt is of an opposite charge polarity to that of the surfactant latex;

(iv) heating the resulting mixture below or about equal to the glass transition temperature (Tg) of the latex resin;

(v) optionally adding a second latex comprised of resin particles suspended in an aqueous phase resulting in a shell;

(vi) adjusting with a base the pH to about 7 to about 9;

(vii) heating the resulting mixture of (vi) above about the Tg of the latex resin;

(viii) retaining the heating until the fusion or coalescence of resin and colorant is initiated;

(ix) changing the pH of the above (viii) mixture with an acid to arrive at a pH of about 1.5 to about 3.5 to thereby accelerate the fusion or the coalescence and resulting in toner particles comprised of resin, and colorant; and (x) optionally isolating the toner.

Illustrated in application U.S. Ser. No. 10/106,519 on Toner Processes, the disclosure of which is totally incorporated herein by reference, is a process for the preparation of a magnetic toner comprising heating a colorant dispersion containing acicular magnetite, a carbon black dispersion, a latex emulsion, and a wax dispersion.

Illustrated in application U.S. Ser. No. 10/106,514 on Toner Processes, the disclosure of which is totally incorporated herein by reference, is a process for the preparation of a magnetic toner comprising the heating of a colorant dispersion comprised of a magnetite dispersion, and a carbon black dispersion, and thereafter mixing with a basic cationic latex emulsion and a wax dispersion.

Illustrated in application U.S. Ser. No. 10/062,129, filed Feb. 4, 2002 on Toner Processes, the disclosure of which is totally incorporated herein by reference, is a process comprising:

(i) providing or generating an emulsion latex comprised of sodio sulfonated polyester resin particles by heating said particles in water at a temperature of from about 65° C. to about 90° C.;

(ii) adding with shearing to said latex (i) a colorant dispersion comprising from about 20 percent to about 50 percent of a predispersed colorant in water, followed by the addition of an organic or an inorganic acid;

(iii) heating the resulting mixture at a temperature of from about 45° C. to about 65° C. followed by the addition of a water insoluble metal salt or a water insoluble metal oxide thereby releasing metal ions and permitting aggregation and coalescence, optionally resulting in toner particles of from about 2 to about 25 microns in volume average diameter; and optionally (iv) cooling the mixture and isolating the product.

Illustrated in applications U.S. Ser. No. 09/877,747, filed Jun. 11, 2001 on Toner Coagulant Processes; U.S. Ser. No. 09/810,138, filed Mar. 19, 2001 on Toner Coagulant Processes; U.S. Ser. No. 09/922,263, filed Aug. 6, 2001 on Toner Coagulant Processes; U.S. Ser. No. 09/960,425, filed Sep. 24, 2001 on Toner Processes; and U.S. Ser. No. 09/976,943, filed Oct. 15, 2001 on Toner Coagulant Processes, the disclosures of which are totally incorporated herein by reference, are toner processes wherein a coagulant may be selected.

In embodiments disclosed herein the appropriate components, and appropriate process aspects of the above copending applications may be selected for the processes of the present invention.

BACKGROUND

The present invention relates to toner processes, and more specifically, to a toner formed from a magnetite aggregation and coalescence processes. More specifically, the present invention in embodiments relates to processes for the preparation of a toner by a chemical process, such as emulsion aggregation, wherein the anionic latex particles selected are aggregated with the colorant particles, such as positively charged magnetite or iron oxides particles, and wherein the positive charge on the magnetite is induced by acidifying colorant dispersion, thus such particles can simultaneously function as colorant particles and as a flocculating or coagulating agent, and thereafter coalescing or fusing to provide toner size particles, which when developed by an electrographic process generates documents suitable for magnetic image character recognition or MICR. In particular, the anionic or the negatively charged latex, which possesses, for example, a pH of about 6.5 to about 7.5, is added to a magnetite dispersion which had been acidified to a pH value of, for example, about 2 to about 2.4 with an acid, thereby inducing a positive charge of about +50 to about +25 coulombs/cm$^2$ on the magnetite particles. To the resulting mixture is then added an anionic carbon black dispersion resulting in a mixture of resin, magnetite, wax and carbon black particles suspended in water in the presence of an anionic surfactant, followed by acidifying the blend to a pH of about 2.2 to about 2.6, and followed by aggregation and coalescence.

REFERENCES

In U.S. Pat. No. 6,132,924, the disclosure of which is totally incorporated herein by reference, there is illustrated a process for the preparation of toner comprising mixing a colorant a latex, and a coagulant, followed by aggregation and coalescence, wherein the coagulant may be a polyaluminum chloride.

In U.S. Pat. No. 6,268,102, the disclosure of which is totally incorporated herein by reference, there is illustrated a process for the preparation of toner comprising mixing a colorant, a latex, and a coagulant, followed by aggregation and coalescence, wherein the coagulant may be a polyaluminum sulfosilicate.

Illustrated in U.S. Pat. No. 5,994,020, the disclosure of which is totally incorporated herein by reference, are toner preparation processes, and more specifically, a process for the preparation of toner comprising:

(i) preparing, or providing a colorant dispersion;

(ii) preparing, or providing a functionalized wax dispersion comprised of a functionalized wax contained in a dispersant mixture comprised of a nonionic surfactant, an ionic surfactant, or mixtures thereof;

(iii) shearing the resulting mixture of the functionalized wax dispersion (ii) and the colorant dispersion (i) with a latex or emulsion blend comprised of resin contained in a mixture of an anionic surfactant and a nonionic surfactant;

(iv) heating the resulting sheared blend of (iii) below about the glass transition temperature (Tg) of the resin particles;

(v) optionally adding additional anionic surfactant to the resulting aggregated suspension of (iv) to prevent, or minimize additional particle growth of the resulting electrostatically bound toner size aggregates during coalescence (iv);

(vi) heating the resulting mixture of (v) above about the Tg of the resin; and optionally, (vii) separating the toner particles.

With respect to the references, only a small part thereof has been selected and this part may or may not be fully representative of the prior art teachings or disclosures.

Magnetic ink printing methods with inks containing magnetic particles are known. For example, there is disclosed in U.S. Pat. No. 3,998,160, the disclosure of which is totally incorporated herein by reference, that various magnetic inks have been used in printing digits, characters, or artistic designs, on checks or bank notes. The magnetic ink used for these processes contains, for example, magnetic particles, such as magnetite in a fluid medium, and a magnetic coating of ferric oxide, chromium dioxide, or similar materials dispersed in a vehicle comprising binders, and plasticizers. According to the disclosure of the '160 patent, there is provided a method of printing on a surface with an ink including magnetic particles permitting the authenticity of the printing can be verified, and wherein a pattern is formed on a carrier with the ink in the wet state, and wherein the particles are subjected to a magnetic aligning process while the ink is on the carrier.

Disclosed in U.S. Pat. No. 4,128,202, the disclosure of which is totally incorporated herein by reference, is a device for transporting a document that has been mutilated or erroneously encoded wherein there is provided a predetermined area for the receipt of correctly encoded magnetic image character recognition information (MICR). As indicated in this patent, the information involved is referred to as MICR characters, which characters appear, for example, at the bottom of personal checks as printed numbers and symbols. These checks have been printed with an ink containing magnetizable particles therein, and when the information contained on the document is to be read, the document is passed through a sorter/reader which first magnetizes the magnetizable particles, and subsequently detects a magnetic field of the symbols resulting from the magnetic retentivity of the ink. The characters and symbols involved, according to the '202 patent are generally segregated into three separate fields, the first field being termed a transient field, which contains the appropriate symbols and characters to identify the bank, bank branch, or the issuing source. The second field contains the account affected by the transactions, and the third field, which is not be prerecorded indicates the amount of the check.

In U.S. Pat. No. 5,914,209, the disclosure of which is totally incorporated by reference, there is illustrated a process for preparing MICR toners using a combination of hard and soft magnetites and lubricating wax in the formulation and melt mixing with a resin followed by jetting and classifying the blend to provide toner compositions.

In U.S. Pat. No. 4,517,268, the disclosure of which is totally incorporated by reference, there is illustrated a process for the preparation of MICR toners by melt mixing the appropriate components in a Banbury apparatus, following by pulverizing the magnetite and the resin, and then jetting and classifying to provide, for example, about 10 to about 12 micron toner size particles, which when mixed with an additive package and carrier can provide a developer suitable for the Xerox Corporation 9700®.

Other patents relating to MICR processes include U.S. Pat. Nos. 4,859,550; 5,510,221, and 5,034,298, the disclosure of which is totally incorporated herein by reference.

In U.S. Pat. No. 5,780,190, the disclosure of which is totally incorporated herein by reference, there is disclosed an ionographic process which comprises the generation of a latent image comprised of characters; developing the image with an encapsulated magnetic toner comprised of a core comprised of a polymer and soft magnetite, and wherein the core is encapsulated within a polymeric shell; and subsequently providing the developed image with magnetic ink characters thereon to a reader/sorter device.

Illustrated in U.S. Pat. No. 4,758,506, the disclosure of which is totally incorporated herein by reference, are single component development cold pressure fixable toner compositions, wherein the shell selected can be prepared by an interfacial polymerization process. Also known are single component magnetic cold pressure fixable toner compositions comprised of magnetite and a polyisobutylene encapsulated in a polymeric shell material generated by an interfacial polymerization process.

In situations requiring MICR capabilities, the toners selected should contain magnetites having specific properties, an important one of which is a high enough level of remanence or retentivity. Retentivity is a measure of the magnetism remaining when the magnetite is removed from the magnetic field, i.e., the residual magnetism. Also, of interest is a high retentivity such that when the characters are read, the magnetites produce a signal, or signal strength of the toner composition. The magnetic signal level is of value in MICR systems, and the signal level can vary in proportion to the amount of toner deposited on the document being generated. The signal strength of the toner composition can be measured by using known devices, including the MICR-Mate 1 manufactured by Checkmate Electronics, Inc.

Forming toner compositions by emulsion aggregation processes are known. For example, emulsion/aggregation/coalescing processes for the preparation of toners are illustrated in a number of Xerox patents, the disclosures of which are totally incorporated herein by reference, such as U.S. Pat. Nos. 5,290,654, 5,278,020, 5,308,734, 5,370,963, 5,344,738, 5,403,693, 5,418,108, 5,364,729, and 5,346,797; and also of interest may be U.S. Pat. Nos. 5,348,832; 5,405,728; 5,366,841; 5,496,676; 5,527,658; 5,585,215;

5,650,255; 5,650,256 and 5,501,935; 5,723,253; 5,744,520; 5,763,133; 5,766,818; 5,747,215; 5,827,633; 5,853,944; 5,804,349; 5,840,462; 5,869,215; 5,869,215; 5,863,698; 5,902,710; 5,910,387; 5,916,725; 5,919,595; 5,925,488 and 5,977,210.

In addition, the following U.S. patents relate to emulsion aggregation processes of forming toner compositions, the disclosures of which are totally incorporated herein by reference.

U.S. Pat. No. 5,922,501 describes a process for the preparation of toner comprising blending an aqueous colorant dispersion and a latex resin emulsion, and which latex resin is generated from a dimeric acrylic acid, an oligomer acrylic acid, or mixtures thereof and a monomer; heating the resulting mixture at a temperature about equal, or below about the glass transition temperature (Tg) of the latex resin to form aggregates; heating the resulting aggregates at a temperature about equal to, or above about the Tg of the latex resin to effect coalescence and fusing of the aggregates; and optionally isolating the toner product, washing, and drying.

U.S. Pat. No. 5,945,245 describes a surfactant free process for the preparation of toner comprising heating a mixture of an emulsion latex, a colorant, and an organic complexing agent.

U.S. Pat. No. 5,482,812 describes a process for the preparation of toner compositions or toner particles comprising (i) providing an aqueous pigment dispersion comprised of a pigment, an ionic surfactant, and optionally a charge control agent; (ii) providing a wax dispersion comprised of wax, a dispersant comprised of nonionic surfactant, ionic surfactant or mixtures thereof; (iii) shearing a mixture of the wax dispersion and the pigment dispersion with a latex or emulsion blend comprised of resin, a counterionic surfactant with a charge polarity of opposite sign to that of said ionic surfactant, and a nonionic surfactant; (iv) heating the above sheared blend below about the glass transition temperature (Tg) of the resin to form electrostatically bound toner size aggregates with a narrow particle size distribution; (v) adding additional ionic surfactant to the aggregated suspension of (iv) to ensure that no, or minimal additional particle growth of the electrostatically bound toner size aggregates occurs on further increasing the temperature to coalesce the aggregates into toner particles (vi); (vi) heating the mixture of (v) with bound aggregates above about or at the Tg of the resin; and optionally (vii) separating the toner particles from the aqueous slurry by filtration and thereafter optionally washing.

U.S. Pat. No. 5,622,806 describes a process, for example, for the preparation of toner compositions with controlled particle size comprising (i) preparing a pigment dispersion in water, which dispersion is comprised of a pigment, an ionic surfactant in amounts of from about 0.5 to about 10 percent by weight to water, and an optional charge control agent; (ii) shearing the pigment dispersion with a latex mixture comprised of a counterionic surfactant with a charge polarity of opposite sign to that of the ionic surfactant, a nonionic surfactant, and resin particles, thereby causing a flocculation or heterocoagulation of the formed particles of pigment, resin, and charge control agent; and (iii) stirring.

SUMMARY

It is a feature of the present invention to provide a magnetite containing toner for Magnetic Ink Character Recognition processes by, for example, utilizing a specific type of magnetite, such as an acicular or needle shape magnetite, to provide an acceptable readability signal by a check reader.

In a further feature of the present invention there is provided a process for the preparation of a MICR toner by an emulsion aggregation, wherein the magnetite or the iron pigment particles are dispersed in water in the presence of an anionic surfactant, which dispersion is then acidified, for example changing the pH of the dispersion which is from about 6.5 to about 6.8, and where the resulting charge on the magnetite particles is from about 0 to about −5 coulombs/$cm^2$, and when acidified with an acid to a pH of about 2 to about 2.4 results in an induction of a positive charge on the magnetite particles of about +40 to about +30 coulombs/$cm^2$, thereby allowing the magnetite particles to also function as a positively charged coagulating agent especially for an anionic latex, and wherein the pH of the latex is about 6.5 to about 7.5 ("anionic neutral latex").

In yet another feature of the present invention there is provided a process in which two separate acidifications are accomplished to induce and retain a positive charge on the surface of the magnetite particles. The acidification usually occurs prior to the addition of an anionic neutral latex wherein the pH of the magnetite and latex mixture is, for example, about 5 to about 5.5, and to which is then added an anionic carbon black dispersion and an anionic wax dispersion, and wherein the blend, which comprises magnetite, latex, carbon black and wax particles, is then acidified by adjusting the pH of the blend of from about 5 to about 5.5 to a pH of about 2.2 to about 2.6 with an acid.

Also, in a feature of the present invention there is provided a process wherein the acidification of a dispersion containing magnetite pigment particles in water, and an anionic surfactant with an acid results in an induction of a positive charge on the magnetite particles, and hence the magnetite particles can function as the primary coagulant and also as a pigment, and wherein a separate external coagulant is avoided.

In a feature of the present invention there is provided a process in which the acidification of the dispersion of magnetite particles results in an increase in the positive surface charge, allowing for the incorporation of an anionic species, such as a latex, a secondary colorant dispersion, and a wax dispersion with a pH of about 6.5 to about 7.5.

Additionally, another feature of the present invention is to provide an improved process for the adhesion of the delayed or second latex resin particles wherein the time required for the complete adhesion is reduced by about 80 percent when compared to a nonacidified magnetite dispersion where the time required for the adhesion is of about 6 to about 8 hours.

It is a further feature of the present invention to provide a MICR toner wherein the particle morphology can be tailored from, for example, a potato to a spherical shape.

It is also a feature of the present invention to provide a MICR toner by emulsion aggregation coalescence process with the full incorporation of needle shape or acicular magnetite particles which are, for example, of a size diameter of about 450 nanometers to about 700 nanometers, and wherein the amount of acicular magnetite loading is about 25 to about 35 weight percent of toner to thereby provide an excellent magnetic signal.

Another feature of the present invention resides in a process for preparing a MICR toner wherein acidification of the magnetite dispersion provides an advantage in which the sequence of the addition of, for example, the secondary colorant, such as carbon black, followed by the addition of a wax can be interchanged without any detrimental effects.

It is yet another feature of the present invention to provide a process that is capable of incorporating into toners a needle shape or acicular magnetite with a coercivity of about twice that of a cubic magnetite to thereby provide an excellent magnetic signal for readability by commercial check readers. The signal is the measure of the standard calibration document as defined by the Banker's Association Standard and Specifications for MICR Encoded Document. Generally, each country sets a minimum percent signal level, for example the minimum signal level in the USA is 50 percent of the nominal, while in Canada it is 80 percent of the nominal. To ensure latitude in the printing process, it is generally desirable to exceed the nominal specification, for example the target signal which is about 115 to about 130 percent of the nominal, to minimize the document rejection rates.

EMBODIMENTS

Aspects of the present invention relate to a process comprising a toner process comprising heating an acidified dispersion of an acicular magnetite with an anionic latex, an anionic carbon black dispersion, and an anionic wax dispersion; a toner process comprising heating a mixture of an acicular magnetite dispersion, a carbon black dispersion, and a latex dispersion, and wherein said magnetite dispersion possesses a low pH; a toner process comprising heating an acidified dispersion of an acicular magnetite with an anionic latex, an anionic carbon dispersion, and optionally an anionic wax dispersion; a process comprising mixing and acidifying a dispersion of acicular magnetite pigment particles, adding an anionic neutral latex emulsion, a carbon black colorant dispersion, and a wax dispersion, followed by a second acidification, and aggregating and coalescing to provide a MICR toner; a process for the preparation of a MICR toner particles, including acicular or needle shape magnetite pigment particles dispersed in water, and an anionic surfactant, which dispersion is acidified to a pH of about 2 with an acid to which is added a latex emulsion comprising submicron, about 0.05 to about 1 micron, resin particles, an anionic surfactant, water, and resin particles, and which emulsion is at a pH of about 6 to about 7.5; blending the resulting magnetite, latex emulsion mixture, a colorant dispersion of carbon black particles dispersed in water, and an anionic surfactant, followed by the addition of a wax dispersion comprised of submicron wax particles of from about 0.1 to about 0.5 micron in diameter by volume, and which wax is dispersed in an anionic surfactant thereby resulting in a mixture of resin, magnetite, carbon black colorant, and wax particles, which mixture is at a pH of about 5 to about 5.5; acidifying the resulting blend to a pH of about 2.2 to about 2.6 with an acid, thereby increasing the positive charge on the magnetite particles to about +50 to about +30 coulombs/cm$^2$ thereby initiating flocculation or aggregation of the resin latex, the colorant, and the wax; heating the resulting mixture below about, or about equal to the glass transition temperature (Tg) of the latex resin; adding to the formed toner aggregates a second latex comprised of resin particles suspended in an aqueous phase containing an anionic surfactant and water, and acidifying with an acid to a pH of about 2.2 to about 2.6, followed by stirring for a sufficient period of time to permit stabilization of the aggregate particle size; adding to the resulting mixture a base to thereby change the pH which is initially from about 2.2 to about 2.6 to arrive at a pH of from about 6.8 to about 7.7 for the resulting toner aggregate mixture; heating the resulting aggregate suspension about above the Tg of the latex resin, while maintaining the pH at a value of about 7.2 to about 7.7; retaining the mixture temperature at from about 80° C. to about 95° C. (degrees Centigrade) optionally for a period of about 10 to about 60 minutes, followed by a pH reduction with an acid to arrive at a pH of about 5.8 to about 6.3; retaining the mixture temperature from about 85° C. to about 95° C. for a period of about 7 to about 14 hours to assist in permitting the fusion or coalescence of the toner aggregates and to obtain smooth particles; cooling, isolating and washing the resulting toner slurry; and isolating the toner; a process wherein acicular magnetite particles are dispersed in water, and an anionic surfactant which dispersion possesses an initial pH of about 6.5 to about 6.8, wherein the magnetite possesses a surface charge of about 1 to about −7 coulombs/cm$^2$, and wherein the magnetite dispersion is acidified by changing the pH to a value of about 2 to about 2.4 with an acid, thereby inducing a positive charge thereon of about +40 to about +30 coulombs/cm$^2$; adding a latex emulsion comprised of submicron resin particles suspended in water and an anionic surfactant whose pH is about 6.5 to about 7.5, wherein the resulting mixture has a pH of about 5 to about 5.5, wherein the positive charge on the magnetite particles is reduced and is about +20 to about +10 coulombs/cm2; adding to the resulting mixture a dispersion of carbon black particles dispersed in water and an anionic surfactant, and adding a wax dispersion dispersed in water and an anionic surfactant, resulting in a blend of magnetite, latex resin particles, carbon black and wax particles, wherein the resulting blend has a pH of about 5 to about 6; acidifying the blend to a pH of about 2 to about 2.6, wherein the positive charge on the magnetite is increased to about +40 to about +30 coulombs/cm$^2$, thereby initiating aggregation of the components; a process wherein the amount of acicular magnetite used is from about 20 to about 35 percent by weight of toner, and more specifically, from about 20 to about 32 percent by weight of toner; a process wherein the acicular utilized exhibits a coercivity of about 250 to about 700 Oe; wherein the acicular magnetite, which can be comprised of 21 percent FeO and 79 percent $Fe_2O_3$ is selected from the group consisting of B2510, B2540, B2550, HDM-S 7111 whose coercivity is each from about 250 to about 500 Oe with a remanent magnetization (Br) of about 23 to 39 emu/g, and a saturation magnetization (Bm) of about 70 to about 90 emu/g, available from Magnox, Inc.; MR-BL whose coercivity of 340 Oe, a remanent magnetization (Br) of about 34 emu/g, and a saturation magnetization (Bm) of about 85 emu/g, available from Titan Kogyo and Columbia; MTA-740 whose coercivity is 370 Oe, a remanent magnetization (Br) of about 30 emu/g, and a saturation magnetization (Bm) of about 83 emu/g, available from Toda Kogyo; AC 5151M whose coercivity is 270 Oe, a remanent magnetization (Br) of about 20 emu/g, and saturation magnetization (Bm) of about 79 emu/g, available from Bayer; MO8029, MO4232, MO4431 whose coercivity is from about 250 to about 400 Oe, a remanent magnetization (Br) of about 23 to 60 emu/g, and saturation magnetization (Bm) of about 70 to about 90 emu/g, available from Elementis; a process wherein the toner exhibits a magnetic signal of from about 115 to about 150 percent of the nominal signal, and a minimum fix temperature (MFT) of about 170° C. to about 195° C.; a process wherein the toner hot offset temperature (HOT) is in excess of about 210° C.; a process wherein the latex resin particles are from about 0.15 to about 0.3 micron in volume average diameter; a process wherein the colorant is a magnetite pigment of a size of about 0.6 micron to about 0.1 micron, and the secondary colorant is carbon black of a size of about 0.01 to about 0.2 micron in average volume diameter; a toner process wherein the acid is selected from the group consisting of nitric, sulfuric, hydrochloric, citric, acetic acid, and the like; the base is selected from the group consisting of sodium hydroxide, potassium hydroxide, and ammonium hydroxide, and there is added to the formed toner aggregates a second latex comprised of submicron resin particles suspended in an aqueous phase containing an anionic surfactant, and wherein the second latex is selected in an amount of from about 10 to about 45 percent by weight of the initial latex and optionally forms a shell thereover on the formed aggregates, and which shell is of a thickness of, for example, about 0.2 to about 0.9 micron; the pH of the mixture resulting is increased from about 2 to about 2.6 to about 6.8 to about 7.5, and wherein the base functions primarily as a stabilizer for the aggregates during coalescence (vii), and no or minimal toner particle size or GSD increases result; a process for the preparation of MICR toner particles comprising iron oxide or magnetite pigment particles dispersed in water and an anionic surfactant, which is acidified to a pH of 2 to about 2.4 with an acid to which is added latex emulsion comprising submicron resin particles, an anionic surfactant, water, and resin particles, and which emulsion is at a pH of about 6.5 to about 7.5;

(ii) blending the magnetite, latex emulsion mixture with a colorant dispersion of carbon black particles dispersed in water and an anionic surfactant, followed by the addition of a wax dispersion comprised of submicron wax particles of from about 0.1 to about 0.8 micron in diameter by volume, and which wax is dispersed in an anionic surfactant resulting in a mixture of resin, magnetite, carbon black colorant, and wax particles, and which mixture possesses a pH of about 5 to about 5.7;

(iii) acidifying the blend of (ii) to a pH of about 2.2 to about 2.6 with an acid, thereby increasing the positive charge on the magnetite particles to about +45 to about +30 coulombs/cm$^2$ thereby initiating flocculation or aggregation of the resin latex, the colorant, the magnetite, and the wax;

(iv) heating the resulting mixture below about, or about equal to the glass transition temperature (Tg) of the latex resin to form toner sized aggregates;

(v) adding to the formed toner aggregates a second latex comprised of resin particles suspended in an aqueous phase containing an anionic surfactant and water, and acidifying to a pH of about 2.2 to about 2.6 with an acid, followed by stirring for a sufficient period of time to permit stabilization of the aggregate particle size;

(vi) adding to the resulting mixture a base to thereby change the pH which is initially from about 2.1 to about 2.6 to a pH of from about 6.8 to about 7.7 for the resulting toner aggregate mixture;

(vii) heating the resulting aggregate suspension of (vi) about above the Tg of the latex resin of (i), while maintaining the pH at a value of about 7.2 to about 7.7;

(viii) retaining the mixture temperature at from about 85° C. to about 95° C. optionally for a period of about 10 to about 60 minutes, followed by a pH reduction with an acid to arrive at a pH of about 5.8 to about 6.3;

(ix) retaining the mixture temperature from about 85° C. to about 95° C. for a period of about 7 to about 15 hours to assist in permitting the fusion or coalescence of the toner aggregates and to obtain smooth particles;

(x) washing; and (xi) isolating the toner; a process wherein the blending and aggregation are performed in the pH range of about 2 to about 2.8, and more specifically, about 2.2 to about 2.8; the coalescence is initially conducted in the pH range of about 6.5 to about 7.5, followed by a reduction in pH to about 5.8 to about 6.3, followed by further heating for a period of about 7 to about 18 hours; a process for preparing a MICR toner composition by emulsion aggregation process, and which toner contains about 25 to about 35 weight percent of acicular or needle shape magnetite, and wherein there are provided smooth particles with a particle size distribution as measured on a Coulter Counter of about 1.20 to about 1.26, and wherein there is provided a MICR signal in the range of about 115 to about 135 percent, and a bulk remanence of about 26 emu/g wherein the remanence is measured on a tapped powder magnetite sample in a cell of 1 centimeter by 1 centimeter by about 4 centimeters; the sample is magnetized between two magnetic pole faces with a saturating magnetic field of 2,000 Gauss, such that the induced magnetic field is perpendicular to one of the 1 by 4 centimeter faces of the cell; the sample is then removed from the saturating magnetic field, and the remanence is measured perpendicular to the above 1 centimeter wide face using a Hall-Effect device or a gaussmeter, such as the F. W. Bell, Inc. Model 615 gaussmeter.

At or slightly above room temperature, about 22° C. to about 25° C., the magnetite pigment dispersion with a pH in the range of about 6.5 to about 6.8 has a positive charge between about 0 (zero) to about −5 coulombs/cm$^2$, and when the dispersion is acidified to a pH of about 2 to about 2.8, the positive charge increases, for example, to about +45 to about +30 coulombs/cm$^2$. The positive charge induced causes in embodiments the magnetite pigment particles to act as a coagulating agent for an anionic species, such as the anionic neutral pH resin latex, the anionic carbon black dispersion comprising carbon black particles dispersed in water in the presence of an anionic surfactant, and an anionic wax dispersion comprising wax particles dispersed in water in the presence of an anionic surfactant, and thus resulting in coagulation of the magnetite, carbon black, wax and resin particles. At about, for example, 20 to about 30 weight percent loading of the acicular magnetite, there is a sufficient positive charge generated to coagulate the latex, carbon black and the wax particles. Loading of less than about 20 weight percent, for example 19 percent, there can be selected an external coagulant, such as metal halides, for example polyaluminum chloride to, for example, provide a narrow toner particle size distribution of, for example, about 1.20 to about 1.25. At the point of zero charge (PZC), the pH is at about 6.5, and as the temperature is increased the PZC decreases in pH value, for example at 93° C. the PZC is 5.3.

Magnetic characteristics associated with the toners generated with the processes of the present invention include, for example, differing shape and excellent magnetic configuration of each character. For example, in a typical signal strength test, a MICR-Mate 1 reading device is calibrated to read the "on-us" character as 100 percent signal strength defined as the nominal. The relative signal strength of test characters for a given toner composition is then measured by reading their characters with the calibrated device. Each test character will read more or less than 100 percent signal strength. The signal is the measure of the standard calibration document as defined by the Banker's Association Standard and Specifications for MICR Encoded Document. Generally, each country sets a minimum percent signal level, for example the minimum signal level in the USA is 50 percent of the nominal, while in Canada it is 80 percent of the nominal. To ensure latitude in the printing process, it is generally desirable to exceed the nominal specification, for example the target signal which is about 115 to about 130 percent of the nominal to minimize the document rejection rates. When magnetites, such as cubic or spherical magnetite, are used to prepare MICR toners by the emulsion aggregation coalescence process, a solids loading, about 60 weight percent or more of magnetite, can be selected to provide the same or similar amount of positive charge as that of 30 weight percent of the acicular magnetite.

Illustrative examples of latex polymer or resin particles include known polymers selected from the group consisting of poly(styrene-butadiene), poly(para-methyl styrene-butadiene), poly(meta-methyl styrene-butadiene), poly (alpha-methyl styrene-butadiene), poly(methylmethacrylate-butadiene), poly(ethylmethacrylate-butadiene), poly(propylmethacrylate-butadiene), poly(butylmethacrylate-butadiene), poly(methylacrylate-butadiene), poly (methylacrylate-butadiene), poly(propylacrylate-butadiene), poly(butylacrylate-butadiene), poly(styrene-isoprene), poly (para-methyl styrene-isoprene), poly(meta-methyl styrene-isoprene), poly(alpha-methylstyrene-isoprene), poly (methylmethacrylate-isoprene), poly(ethylmethacrylate-isoprene), poly(propylmethacrylate-isoprene), poly (butylmethacrylate-isoprene), poly(methylacrylate-isoprene), poly(ethylacrylate-isoprene), poly (propylacrylate-isoprene), and poly(butylacrylate-isoprene); and terpolymers such as poly(styrene-butadiene-acrylic acid), poly(styrene-butadiene-methacrylic acid), PLIOTONE™ available from Goodyear.

The resin particles selected, which generally can be in embodiments styrene acrylates, styrene butadienes, styrene methacrylates, or polyesters, are present in various effective amounts, such as from about 70 weight percent to about 98 weight, and more specifically, about 80 to about 92 percent of the toner, which resin can be of small average particle size, such as from about 0.01 micron to about 1 micron in average volume diameter as measured by the Brookhaven nanosize particle analyzer. Other effective amounts of resin can be selected.

The resin particles selected can be prepared by, for example, emulsion polymerization techniques, including semicontinuous emulsion polymerization methods, and the monomers utilized in such processes can be selected from, for example, styrene, acrylates, methacrylates, butadiene, isoprene, and optionally acid or basic olefinic monomers, such as acrylic acid, methacrylic acid, acrylamide, methacrylamide, quaternary ammonium halide of dialkyl or trialkyl acrylamides or methacrylamide, vinylpyridine, vinylpyrrolidone, vinyl-N-methylpyridinium chloride, and the like. The presence of acid or basic groups in the monomer or polymer resin is optional, and such groups can be present in various amounts of from about 0.1 to about 10 percent by weight of the polymer resin. Chain transfer agents, such as dodecanethiol or carbon tetrabromide, can also be selected when preparing resin particles by emulsion polymerization. Other processes of obtaining resin particles of from about 0.01 micron to about 1 micron can be selected from polymer microsuspension process, such as illustrated in U.S. Pat. No. 3,674,736, the disclosure of which is totally incorporated herein by reference, polymer solution microsuspension process, such as disclosed in U.S. Pat. No. 5,290,654, the disclosure of which is totally incorporated herein by reference, mechanical grinding process, or other known processes.

Examples of anionic surfactants suitable for use in the resin latex dispersion include, for example, sodium dodecylsulfate (SDS), sodium dodecylbenzene sulfonate, sodium dodecylnaphthalene sulfate, dialkyl benzenealkyl, sulfates and sulfonates, abitic acid, available from Aldrich, NEOGEN RK™, NEOGEN SCT™ from Kao, and the like. An effective concentration of the anionic surfactant generally employed is, for example, from about 0.01to about 10 percent by weight, and more specifically, from about 0.1 to about 5 percent by weight of monomers used to prepare the toner polymer resin.

Examples of nonionic surfactants that may be included in the resin latex dispersion include, for example, polyvinyl alcohol, polyacrylic acid, methalose, methyl cellulose, ethyl cellulose, propyl cellulose, hydroxy ethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, dialkylphenoxypoly(ethyleneoxy) ethanol, available from Rhodia as IGEPAL CA-210™, IGEPAL CA-520™, IGEPAL CA-720™, IGEPAL CO-890™, IGEPAL CO-720™, IGEPAL CO-290™, IGEPAL CA-210™, ANTAROX 890™ and ANTAROX 897™. A suitable concentration of the nonionic surfactant is, for example, from about 0.01 to about 10 percent by weight, and preferably from about 0.1 to about 5 percent by weight of monomers used to prepare the toner polymer resin. The acicular magnetite pigment dispersion of the invention is not particularly limited in composition or method of preparation. The pigment dispersion should most preferably comprise pigment particles dispersed in an aqueous medium with a nonionic dispersant/surfactant. A dispersant having the same polarity as that of the resin latex dispersion might also be used.

In some instances, pigments are available in the wet cake or concentrated form containing water, and can be easily dispersed utilizing a homogenizer, or simply by stirring, ball milling, attrition, or media milling. In other instances, pigments are available only in a dry form, whereby dispersion in water is effected by microfluidizing using, for example, a M-110 microfluidizer or an ultimizer and passing the pigment dispersion from 1 to 10 times through the chamber, or by sonication, such as using a Branson 700 sonicator, or a homogenizer, ball milling, attrition, or media milling with the optional addition of dispersing agents such as the aforementioned ionic or nonionic surfactants. In the instance of preparing carbon black pigment or other pigment dispersion, the above techniques can also be applied in the presence of a surfactant.

Acicular magnetite selected which can, for example, be comprised of 21 percent FeO and 79 percent $Fe_2O_3$ possess a coercivity of about 250 to about 700 Oe with a particle size in the range of about 0.6 micron in length×0.1 micron in diameter; B2510, B2540, B2550, HDM-S 7111 whose coercivity is from about 250 to about 500 Oe, a remanent magnetization (Br) is about 23 to 39 emu/g, and saturation magnetization (Bm) is about 70 to about 90 emu/g, available from Magnox, Inc.; MR-BL whose coercivity is 340 Oe, a remanent magnetization (Br) of about 34 emu/g, and a saturation magnetization (Bm) of about 85 emu/g, available from Titan Kogyo and Columbia Chemicals; MTA-740 whose coercivity is 370 Oe, a remanent magnetization (Br) of about 30 emu/g, and a saturation magnetization (Bm) of about 83 emu/g, available from Toda Kogyo; AC 5151M whose coercivity is 270 Oe, a remanent magnetization (Br) of about 20 emu/g, and a saturation magnetization (Bm) of about 79 emu/g, available from Bayer Corporation; and MO8029, MO4232, MO4431 whose coercivity is from about 250 to about 400 Oe, a remanent magnetization (Br)

of about 23 to 60 emu/g, and a saturation magnetization (Bm) of about 70 to about 90 emu/g, available from Elementis, Inc. The acicular magnetite selected can be present in the amounts of from about 10 to about 35 weight percent and preferably in amounts of about 22 to about 32 weight percent by weight of toner.

The magnetite dispersion comprising magnetite particles in water containing an anionic surfactant or an nonionic surfactant can be prepared by ball milling, attrition, polytroning, homogenization, or media milling resulting in magnetite particle stabilized by the surfactant, and wherein the dispersion is then aggregated with latex particles and wax particles to obtain a MICR toner. Any suitable dispersant may be selected for the pigment dispersions, including nonionic and/or anionic surfactants or dispersants. Also, there is no particular limitation upon the solids content of the pigment dispersion; the solids content may range from, for example, about 10 to about 90 percent. The resin latex dispersion and the pigment dispersion in embodiments are first blended together. Any well known type of wax dispersion might also optionally be included in this blend including, for example, an aqueous based, 10w $M_w$, 1,000 to about 10,000, polyethylene or polypropylene wax containing an anionic surfactant as a dispersant. The blending obtains a resin-pigment-colorant wax blend. The blending may be effected by any suitable means known in the art, for example homogenization, including stirring. The acidified magnetite pigment dispersion acting as a coagulant in the presence of a neutral anionic latex emulsion, a dispersion of an anionic carbon black colorant, and an anionic wax dispersion is then preferably subjected to high shear, for example a rotor stator device by stirring with a blade at about 3,000 to 10,000 rpm, and more specifically, about 5,000 rpm for 1 to 120 minutes. A high shearing device, for example an intense homogenization device, such as the in-line IKA SD-41, may be used to further assure that the blend is homogeneous and uniformly dispersed. This high shear effects homogenization of the resin-pigment and the wax when present.

Following homogenization aggregation of the homogenized composition is effected by heating to a temperature below the glass transition temperature (Tg) of the resin of the latex while agitating the composition; the temperature of the heating is from, for example, about 5° C. to about 20° C. below the Tg of the resin. The agitation preferably comprises continuously stirring the mixture using a mechanical stirrer at between, for example, 200 to 800 rpm.

The aggregation is conducted for a period of time until the aggregate particle size is stabilized, which may be from, for example, about 10 minutes to about 2 hours. The delayed latex can comprise the same latex formulation that is used initially during the blending of the magnetite, latex, carbon black, and wax particles, or the latex can comprise a different composition, including molecular properties, Tg, or optionally can be an acidic anionic latex; further mixing for a period of about 30 to about 60 minutes permits the latex resin to be adhered to the aggregates.

Following aggregation and the addition of the remaining delayed components into the composition, the particles are coalesced by first changing the pH to about 6 to about 8 to primarily prevent the aggregates from further growth, followed by heating at a temperature above the Tg of the resin in the toner particles. Preferably, the heating for coalescing is conducted at a temperature of from about 10° C. to about 50° C., and preferably about 25° C. to about 40° C. above the Tg of the resin for about 30 minutes to about 14 hours.

During the coalescence, the pH is increased, for example, to about 6.8 to about 7.7 by any suitable pH increasing agent, for example sodium hydroxide. The increase in pH can stabilize the aggregate particle and can prevent any further growth of and loss of GSD during further heating, for example raising the temperature about 10° C. to about 50° C. above the resin Tg. After about 30 to about 90 minutes at the coalescence temperature, the pH is then gradually decreased back in the range of about 5.8 to about 6.8, wherein the reduction in pH permits the coalescence or the fusion process. The preferred pH reducing agents include, for example, nitric acid, citric acid, sulfuric acid or hydrochloric acid, and the like. In embodiments, a multi-stage addition of latex is conducted, that is only a portion of the total amount of latex to be added into the composition is initially present in the composition subjected to homogenization and aggregation; thus a majority, over 50 percent, of the latex is added at the onset while the remainder of the latex (the delayed latex) is added after the formation of the resin-pigment aggregates. This delayed addition of latex can improve formation of an outer shell of nonpigmented material around the pigmented core, thereby better encapsulating the pigment in the core of the particles and away from the toner particles surface, where the presence of magnetite pigment can modify the charging behavior of the toner particles. Homogenization is accomplished to further ensure the formation of particles with a narrow geometric size distribution (GSD).

Following the pH changes, the coalesced toner particles obtained may optionally be separated and dried by any suitable technique known in the art. The particles may also be washed with, for example, hot water to remove surfactant, and dried such as by use of an aeromatic fluid bed dryer.

The toner particles obtained may also include known charge additives in effective amounts of, for example, from about 0.1 to about 5 weight percent, such as alkyl pyridinium halides, bisulfates, the charge control additives of U.S. Pat. Nos. 3,944,493; 4,007,293; 4,079,014; 4,394,430 and 4,560,635, the disclosures of which are totally incorporated herein by reference, and the like. Surface additives that can be added to the toner compositions after washing or drying include, for example, metal salts, metal salts of fatty acids, colloidal silicas, metal oxides, mixtures thereof, and the like, which additives are usually present in an amount of from about 0.1 to about 2 weight percent, reference U.S. Pat. Nos. 3,590,000, 3,720,617, 3,655,374 and 3,983,045, the disclosures of which are totally incorporated herein by reference. Preferred additives include zinc stearate and AEROSIL R972® available from Degussa in amounts of from about 0.1 to about 2 percent which can be added during the aggregation process or blended into the formed toner product.

Developer compositions can be prepared by mixing the toners obtained with the process of the present invention with known carrier particles, including coated carriers, such as steel, ferrites, and the like, reference U.S. Pat. Nos. 4,937,166 and 4,935,326, the disclosures of which are totally incorporated herein by reference, for example from about 2 percent toner concentration to about 8 percent toner concentration.

By the process of the invention, toner particles of acceptable size and narrow dispersity can be obtained in a more rapid method. The toner particles possess, for example, an average volume diameter of from about 0.5 to about 25, and preferably from about 1 to about 10 microns, and a narrow GSD characteristic of from about 1.05 to about 1.25, and preferably of from about 1.15 to about 1.25 as measured by a Coulter Counter. The toner particles also have an excellent shape factor, for example, of 120 or less wherein the shape factor is a measure of smoothness and roundness, where a shape factor of 100 is considered substantially perfectly spherical and smooth, while a shape factor greater than about 150 can be considered to be rough in surface morphology.

The following Examples illustrate the embodiments and advantages of the present invention. Parts and percentages are by weight unless otherwise indicated.

EXAMPLES

Latex A Formation Procedure—Neutral Anionic Latex

A latex emulsion (i) comprised of polymer particles generated from the emulsion polymerization of styrene, butyl acrylate and beta carboxy ethyl acrylate (beta CEA) was prepared as follows. A surfactant solution of 1.5 kilograms of Poly-Tergent C51 obtained from BASF (anionic emulsifier) and 430 kilograms of deionized water containing 2.6 kilograms of sodium carbonate and 1.8 kilograms of sodium bicarbonate was prepared by mixing these components for 10 minutes in a stainless steel holding tank. The holding tank was then purged with nitrogen for 5 minutes before transferring the mixture into a reactor. The reactor was then continuously purged with nitrogen while the mixture therein was being stirred at 100 RPM. The reactor was then heated to 80° C.

Separately, 6.11 kilograms of an ammonium persulfate initiator were dissolved in 30.2 kilograms of deionized water.

Also, separately a monomer emulsion A was prepared in the following manner. 366 Kilograms of styrene, 86 kilograms of butyl acrylate, 14 kilograms of beta CEA, 6 kilograms of 1-dodecanethiol, 8 kilograms of Poly-Tergent C 51 from BASF (anionic surfactant), and 261 kilograms of deionized water containing 1.3 kilograms of sodium carbonate and 0.9 kilogram of sodium bicarbonate were mixed to form an emulsion (A). Five percent of the above emulsion (A) was then slowly fed into the reactor containing the above aqueous surfactant phase comprised of water and anionic surfactant at 80° C. to form the seeds wherein "seeds" refer, for example, to the initial emulsion latex (i) added to the reactor, prior to the addition of the initiator solution. The above initiator solution was then slowly charged into the reactor forming latex seed particles of about 5 to about 12 nanometers in diameter. After 10 minutes, the remaining (95 percent) of the emulsion was continuously fed into the reactor using metering pumps.

After the above was charged into the main reactor, the temperature was maintained at 80° C. for an additional 2 hours to complete the reaction. The reactor contents were then cooled down to about 25° C. The resulting isolated product was comprised of 40 weight percent of submicron, 0.5 micron volume average diameter, resin particles of styrene/butylacrylate/beta CEA in a ratio of 73.5:26.5:3 pph, respectively, suspended in an aqueous phase containing the above surfactant, and which product had a pH of 6.8. The molecular properties resulting for the resin latex were $M_w$ of 60,000, $M_n$ of 10,800, each measured by a Gel Permeation Chromatograph, and a midpoint Tg of 55.8° C., as measured by a Differential Scanning Calorimeter, where the midpoint Tg is defined as the halfway point between the onset and the offset Tg of the polymer.

Latex B Formation Procedure—Acidic Anionic Latex

A latex emulsion (i) comprised of polymer particles generated from the emulsion polymerization of styrene, butyl acrylate and beta carboxy ethyl acrylate (beta CEA) was prepared as follows. A surfactant solution of 434 grams of DOWFAX 2A1™ (anionic emulsifier) and 387 kilograms of deionized water was prepared by mixing these components for 10 minutes in a stainless steel holding tank. The holding tank was then purged with nitrogen for 5 minutes before transferring the mixture into a reactor. The reactor was then continuously purged with nitrogen while being stirred at 100 RPM. The reactor was then heated to 80° C.

Separately, 6.11 kilograms of an ammonium persulfate initiator were dissolved in 30.2 kilograms of deionized water. Also, separately a monomer emulsion (A) was prepared in the following manner. 315.7 Kilograms of styrene, 91.66 kilograms of butyl acrylate, 12.21 kilograms of beta CEA, 7.13 kilograms of 1-dodecanethiol, 1.42 kilograms of decanediol diacrylate (ADOD), 8.24 kilograms of DOWFAX™ (anionic surfactant), and 193 kilograms of deionized water were mixed to form an emulsion (A). Five percent of the above emulsion (A) was then slowly fed into the reactor containing the aqueous surfactant phase comprised of the above resin, water and anionic surfactant and heated at 80° C. to form seeds wherein the "seeds" refer to the initial emulsion latex (i) added to the reactor prior to the addition of the initiator solution, and while being purged with nitrogen. The above initiator solution was then slowly charged into the reactor, forming seeds of a diameter of about 5 to about 12 nanometers. After 10 minutes, the remaining (95 percent) of the emulsion was continuously fed into the reactor using metering pumps.

After all of the above was charged into the main reactor, the temperature was maintained at 80° C. for an additional 2 hours to complete the reaction. The reactor contents were then cooled down to about 25° C. The resulting isolated product was comprised of 40 weight percent of submicron, 0.5 micron volume average diameter, resin particles of styrene/butylacrylate/beta CEA ratio of 73.5:26.5:3 pph, respectively, suspended in an aqueous phase containing the above surfactant, and which product was at a pH of about 1.8. The molecular properties resulting for the resin latex were $M_w$ of 39,000, $M_n$ of 10,800, as measured by a Gel Permeation Chromatograph, and a midpoint Tg of 55.8° C., as measured by a Differential Scanning Calorimeter, where the midpoint Tg is the halfway point between the onset and the offset Tg of the polymer.

Wax and Pigment Dispersions

The aqueous wax dispersion utilized in these Examples was generated using P725 ($M_w$ 725) polyethylene wax of a weight average molecular weight of 725 and a melting point of 104° C. or P850 ($M_w$ 850) wax with a melting point of 107° C. and NEOGEN RK™ as an anionic surfactant/dispersant. The waxes are available from Baker-Petrolite. The wax particle size was determined to be approximately 200 nanometers and the wax slurry was supplied with a solid loading of about 28 to about 30 percent.

The pigment dispersion utilized was an aqueous dispersion of carbon black REGAL 330® pigment supplied from Sun Chemicals. This pigment dispersion contained an anionic surfactant (NEOGEN RK™) with the pigment content of the dispersion as supplied being 18 percent with 2 percent of anionic surfactant and 80 percent of water.

Example I

30 Percent Acicular Magnetite with P725 Wax

95 Grams of the acicular black magnetite (B2550) composed of 21 percent FeO and 79 percent $Fe_2O_3$ having a particle size of 0.6 micron×0.1 micron were dispersed in 600 grams of water containing 1.2 grams of 20 percent aqueous anionic surfactant (NEOGEN RK™) by ball milling for a period of 1 hour. The pH of the dispersion was found to be 6.7. A 4 percent nitric acid solution was then added to the magnetite dispersion to acidify the dispersion to a pH of 2.

The magnetite dispersion was transferred into a reaction kettle to which there were added 330 grams of a neutral anionic latex (latex A) having a pH of 6.8, and comprising 250 nanometers of submicron latex particles (40 percent solids) of styrene/butylacrylate/beta CEA. The resultant pH of the magnetite and the latex blend was found to be about 5.3, to which were added 83 grams of a carbon black (18 percent solids, 2 percent anionic surfactant, and 80 percent water), followed by 90 grams dispersion of 200 nanometers of polyethylene P725 wax particles (30 percent solids, 2 percent anionic surfactant, 68 percent water). The pH of the mixture comprising magnetite, resin latex, carbon black and wax particles was found to be 5.4, which mixture was then acidified to a pH of about 2.4 with a 4 percent nitric acid solution.

The resulting blend having a pH of 2.4 was then heated to a temperature of 50° C. for a period of 150 minutes to obtain toner size aggregates of 6.3 microns (volume average diameter throughout) with a GSD of 1.21 each as measured on a Coulter Counter. 130 Grams of the above latex A was then added to the aggregate mixture and the pH readjusted from a pH of about 3.2 to about 2.4 with a 4 percent nitric acid followed by stirring for 45 minutes at a temperature of 50° C., resulting in a particle size of 6.6 microns with a GSD of 1.20. The resulting aggregate mixture was changed to a pH of 7.4 by the addition of an aqueous solution of a 4 percent sodium hydroxide. The mixture was then heated to 93° C. during which the pH was maintained between about 7.2 to about 7.4 with the addition of an aqueous 4 percent sodium hydroxide solution. After 30 minutes at 93° C., the pH was reduced in stages (e.g. 7.3 to 6.5 to 5.8) with an aqueous 2.5 percent nitric acid solution over a period of 1 hour. After a period of 10 hours at 93° C., the particle size measured was 6.9 microns with a GSD of 1.22. The resultant mixture was cooled and the toner obtained was washed 4 times with water and dried. The resulting toner was comprised of 30 percent magnetite, 57.1 percent styrene-butyl acrylate beta CEA resin, 4.4 percent carbon black, and 8.5 percent wax providing a magnetite signal of 118 percent of nominal where nominal was 100 percent and a remanence of 25.5 emu/g.

Example II

P850 Wax

95 Grams of acicular black magnetite (B2550) composed of 21 percent FeO and 79 percent $Fe_2O_3$ having a particle size of 0.6 micron×0.1 micron was dispersed in 600 grams of water containing 1.2 grams of a 20 percent aqueous anionic surfactant (NEOGEN RK™) by ball milling for a period of 1 hour. The pH of the dispersion was found to be 6.7. A 4 percent nitric acid solution was then added to the magnetite dispersion to acidify the dispersion to a pH value of 2. The magnetite dispersion was transferred into a reaction kettle to which there were added 330 grams of a neutral anionic latex (latex A) having a pH of 6.8, and comprising 250 nanometers of submicron latex particles (40 percent solids) of styrene/butylacrylate/beta CEA. The resultant pH of the magnetite and the latex blend was found to be about 5.3, to which were added 83 grams of a carbon black (18 percent solids, 2 percent anionic surfactant, and 80 percent water), followed by the addition of 90 grams dispersion of 200 nanometers of polyethylene P850 wax particles (30 percent solids, 2 percent anionic surfactant, 68 percent water). The pH of the mixture comprising magnetite, resin latex, carbon black and wax particles was found to be 5.4, which mixture was then acidified to a pH of about 2.4 with a 4 percent nitric acid solution.

The resulting blend having a pH of 2.4 was then heated to a temperature of 50° C. for a period of 135 minutes to obtain toner size aggregates of 6.2 microns (volume average diameter throughout) with a GSD of 1.20 each as measured on a Coulter Counter. 130 Grams of the above latex A was then added to the aggregate mixture and the pH readjusted from a pH of about 3.2 to about 2.4 with a 4 percent nitric acid followed by stirring for 45 minutes at a temperature of 50° C., resulting in a particle size of 6.5 microns with a GSD of 1.20. The aggregate mixture was changed to a pH of 7.4 with an aqueous solution of 4 percent sodium hydroxide. The mixture was then heated to 93° C. during which the pH was maintained between about 7.2 to about 7.4 with the addition of an aqueous 4 percent sodium hydroxide solution. After 30 minutes at 93° C., the pH was reduced in stages (e.g. 7.3 to 6.5 to 5.8) with an aqueous 2.5 percent nitric acid solution over a period of 1 hour. After a period of 10 hours at 93° C., the particle size measured was 6.8 microns with a GSD of 1.21. The resultant mixture was cooled and the toner obtained was washed 4 times with water and dried. The resulting toner was comprised of 30 percent magnetite, 57.1 percent styrene-butyl acrylate beta CEA resin, 4.4 percent carbon black, and 8.5 percent wax providing a magnetite signal of 119 percent of nominal where nominal signal refers to 100 percent and a remanence of 25.7 emu/g.

Example III

P 725 Wax—Combo Latex A/B

95 Grams of an acicular black magnetite (B2550) composed of 21 percent FeO and 79 percent $Fe_2O_3$ having a particle size of 0.6 micron by 0.1 micron were dispersed in 600 grams of water containing 1.2 grams of a 20 percent aqueous anionic surfactant (NEOGEN RK™) by ball milling for a period of 1 hour. The pH of the dispersion was found to be 6.7. A 4 percent nitric acid solution was then added to the magnetite dispersion to acidify the dispersion to a pH of 2. The magnetite dispersion was transferred into a reaction kettle to which were added 330 grams of the neutral anionic latex (latex A) having a pH of 6.8, and comprising 250 nanometers of submicron latex particles (40 percent solids) of styrene/butylacrylate/beta CEA. The resultant pH of the magnetite and the latex blend was found to be about 5.3, to which was added 83 grams of carbon black (18 percent solids, 2 percent anionic surfactant, and 80 percent water), followed by 90 grams of a dispersion of 200 nanometers of polyethylene P725 wax particles (30 percent solids, 2 percent anionic surfactant, 68 percent water). The pH of the resulting mixture comprising magnetite, resin latex, carbon black and wax particles was found to be 5.4, which was then acidified to a pH of about 2.4 with a 4 percent nitric acid solution.

The above resulting blend having a pH of 2.4 was then heated to a temperature of 50° C. for a period of 140 minutes to obtain toner size aggregates of 6.4 microns (volume average diameter throughout) with a GSD of 1.21 each as measured on a Coulter Counter. 130 Grams of the above latex B (acidic) were then added to the aggregate mixture and left stirring for 45 minutes at a temperature of 50° C., resulting in a particle size of 6.6 microns with a GSD of 1.20. The pH aggregate mixture was changed to 7.4 by the addition of an aqueous solution of 4 percent sodium hydroxide. The mixture resulting was then heated to 93° C. during which the pH was maintained at about 7.2 to about 7.4 with the addition of an aqueous 4 percent sodium hydroxide solution. After 30 minutes at 93° C., the pH was reduced in stages (e.g. 7.3 to 6.5 to 5.8) with an aqueous 2.5 percent nitric acid solution over a period of 1 hour. After a period of 10 hours at 93° C., the particle size measured was 6.8 microns with a GSD of 1.21. The resultant mixture was cooled and the toner obtained was washed 4 times with water and dried on a freeze dryer. The resulting toner was comprised of 30 percent magnetite, 57.1 percent styrene-butyl acrylate beta CEA resin, 4.4 percent carbon black, and 8.5 percent wax, and which toner provided a magnetite signal of 118 percent of nominal where nominal signal is 100 percent, and a remanence of 25.5 emu/g.

Example IV

P850 Wax—Latex A/B

95 Grams of the acicular black magnetite (B2550) composed of 21 percent FeO and 79 percent $Fe_2O_3$ having a particle size of 0.6 micron×0.1 micron was dispersed in 600 grams of water containing 1.2 grams of a 20 percent aqueous anionic surfactant (NEOGEN RK™) by ball milling for a period of 1 hour. The pH of the dispersion was found to be 6.7. A 4 percent nitric acid solution was then added to the magnetite dispersion to acidify the dispersion to a pH value of 2. The magnetite dispersion was transferred into a reaction kettle to which 330 grams of the neutral anionic latex (latex A), having a pH of 6.8, and comprising 250 nanometers submicron latex particles (40 percent solids) of styrene/butylacrylate/beta CEA. The resultant pH of the magnetite and the latex blend was found to be about 5.3, to which were added 83 grams of carbon black (REGAL 330® throughout) (18 percent solids, 2 percent anionic surfactant, and 80 percent water), followed by the addition of 90 grams of a dispersion of 200 nanometers of polyethylene P850 wax particles (30 percent solids, 2 percent anionic surfactant, 68 percent water). The pH of the resulting mixture comprising magnetite, resin latex, carbon black and wax particles was found to be 5.4, which mixture was then acidified to a pH of about 2.4 with a 4 percent nitric acid solution.

The above resulting blend having a pH of 2.4 was then heated to a temperature of 50° C. for a period of 145 minutes to obtain toner size aggregates of 6.4 microns (volume average diameter throughout) with a GSD of 1.19 as measured on a Coulter Counter. 130 Grams of the above latex B was then added to the aggregate mixture and stirred for 45 minutes at a temperature of 50° C., resulting in a particle size of 6.5 microns with a GSD of 1.20. The resulting pH aggregate mixture was changed to a pH of 7.4 by the addition of an aqueous solution of 4 percent sodium hydroxide. The mixture was then heated to 93° C. during which the pH is maintained at about 7.2 to about 7.4 with the addition of a 4 percent sodium hydroxide solution. After 30 minutes at 93° C., the pH was reduced in stages (e.g. 7.3 to 6.5 to 5.8) by the addition of an aqueous 2.5 percent nitric acid solution over a period of 1 hour. After a period of 10 hours at 93° C., the particle size measured was 6.8 microns with a GSD of 1.20. The resultant mixture was cooled and the toner obtained was washed 4 times with water and dried on a freeze dryer. The resulting toner was comprised of 30 percent magnetite, 57.1 percent styrene-butyl acrylate beta CEA resin, 4.4 percent carbon black, and 8.5 percent wax, and which toner provided a magnetite signal of 120 percent of nominal where nominal signal is 100 percent and a remanence of 25.6 emu/g.

Although not being desired to be in embodiments limited by theory, it is believed that the magnetite or iron oxide particles exhibit a positive charge in water at a low pH, for example below about 4, and a negative charge at a high pH, for example above about 6; thus, when positively charged, the magnetite can aggregate with a negatively charged latex, which latex can be at a pH of about 6 to about 9, and wherein the magnetite like iron oxides, hematite, fully oxidized $Fe_2O_3$, and the like, and which magnetites possess a unique point of zero charge (PZC) at 25° C. at, for example, a pH of 6.5 for magnetite and 6.3 for hematite; and also in embodiments where oxides of, for example, aluminum oxide, titanium oxide, and zirconium oxide can be selected in place of the magnetite.

Other embodiments and modifications of the present invention may occur to those skilled in the art subsequent to a review of the information presented herein; these embodiments and modifications, equivalents thereof, substantial equivalents thereof, or similar equivalents thereof are also included within the scope of this invention.

What is claimed is:

1. A toner process comprising heating an acidified dispersion of an acicular magnetite with an anionic latex, an anionic carbon black dispersion, and an anionic wax dispersion.

2. A process in accordance with claim 1 wherein (i) said acicular comprises needle shape magnetite particles dispersed in water, and an anionic surfactant, which dispersion is acidified to a pH of about 2 to about 3 with an acid, subsequently adding said latex containing submicron resin particles, an anionic surfactant, and water, and which latex is at a pH of about 6.5 to about 7.5;

(ii) blending said magnetite and latex mixture of (i) with a colorant dispersion of carbon black particles dispersed in water and an anionic surfactant, followed by the addition of a wax dispersion comprised of submicron wax particles of from about 0.1 to about 0.5 micron in diameter by volume, and which wax is dispersed in an anionic surfactant thereby resulting in a mixture of magnetite, carbon black colorant, and wax particles with a pH of about 5 to about 5.5;

(iii) acidifying the blend of (ii) to a pH of about 2.2 to about 2.6 with an acid, thereby increasing the positive charge on the magnetite particles to about +30 to about +45 coulombs/$cm^2$ thereby initiating flocculation or aggregation of the resin latex, the magnetite, the carbon black, and the wax;

(iv) heating the resulting mixture below about the glass transition temperature (Tg) of the latex resin to form toner sized aggregates;

(v) optionally adding to the formed toner aggregates a second latex comprised of resin particles suspended in an aqueous phase containing an anionic surfactant and water, and acidifying said second latex to a pH of about 2.2 to about 2.6 with an acid, optionally followed by stirring for a sufficient period of time to permit stabilization of the aggregate particle size;

(vi) adding to the resulting mixture a base to thereby change the pH, which is initially from about 2.2 to about 2.6, to arrive at a pH of from about 6.8 to about 7.7 for the resulting toner aggregate mixture;

(vii) heating the resulting aggregate mixture of (vi) about above the Tg of the latex resin of (i), while maintaining the pH at a value of about 7.2 to about 7.7;

(viii) retaining the mixture temperature at from about 75° C. to about 95° C. optionally for a period of about 10 to about 60 minutes, followed by a pH reduction with an acid to arrive at a pH of about 5.8 to about 6.3;

(ix) optionally retaining the mixture temperature from about 80° C. to about 95° C. for a period of about 7 to about 14 hours to assist in permitting the fusion or coalescence of the toner aggregates and to obtain smooth toner particles;

(x) optionally washing the resulting toner slurry; and (xi) isolating the toner.

3. A process in accordance with claim 2 wherein said acid is selected from the group consisting of nitric, sulfuric, hydrochloric, citric and acetic acids.

4. A process in accordance with claim 2 wherein said base is selected from the group consisting of sodium hydroxide, potassium hydroxide, and ammonium hydroxide.

5. A process in accordance with claim 2 wherein there is added to the formed toner aggregates said second latex comprised of submicron resin particles suspended in an aqueous phase containing an anionic surfactant, and wherein said second latex is selected in an amount of from about 10 to about 40 percent by weight of the initial latex (i) to form a shell thereover on said formed aggregates, and which shell is of an optional thickness of about 0.2 to about 0.8 micron.

6. A process in accordance with claim 5 wherein the added latex contains the same resin as the initial latex of (i), or wherein said added latex contains a dissimilar resin than that of the initial latex.

7. A process in accordance with claim 2 (v) wherein the pH of the mixture resulting in (vi) is increased from about 2 to about 2.6 to about 6.8 to about 7.7, and wherein said base functions primarily as a stabilizer for the aggregates during coalescence (vii), and no or minimal toner particle size increase results.

8. A process in accordance with claim 2 wherein the temperature at which toner sized aggregates are formed controls the size of the aggregates, and wherein the final toner size is from about 5 to about 15 microns in volume average diameter.

9. A process in accordance with claim 2 wherein the aggregation (iv) temperature is from about 45° C. to about 60° C., and wherein the temperature of (vii) and (viii) is from about 85° C. to about 95° C. resulting in coalescence of said carbon black, said magnetite, said wax, and said latex resin.

10. A process in accordance with claim 9 wherein the time of coalescence is from about 6 to about 15 hours, and wherein there are provided toner particles with a smooth morphology.

11. A process in accordance with claim 2 wherein the latex contains a resin selected from the group consisting of poly(styrene-butadiene), poly(methylstyrene-butadiene), poly(methyl methacrylate-butadiene), poly(ethyl methacrylate-butadiene), poly(propyl methacrylate-butadiene), poly(butyl methacrylate-butadiene), poly (methyl acrylate-butadiene), poly(ethyl acrylate-butadiene), poly(propyl acrylate-butadiene), poly(butyl acrylate-butadiene), poly(styrene-isoprene), poly(methylstyrene-isoprene), poly(methyl methacrylate-isoprene), poly(ethyl methacrylate-isoprene), poly(propyl methacrylate-isoprene), poly(butyl methacrylate-isoprene), poly(methyl acrylate-isoprene), poly(ethyl acrylate-isoprene), poly (propyl acrylate-isoprene), poly(butyl acrylate-isoprene), poly(styrene-propyl acrylate), poly(styrene-butyl acrylate), poly(styrene-butadiene-acrylic acid), poly(styrene-butadiene-methacrylic acid), poly(styrene-butadiene-acrylonitrile-acrylic acid), poly(styrene-butyl acrylate-acrylic acid), poly(styrene-butyl acrylate-methacrylic acid), poly(styrene-butyl acrylate-acrylononitrile), and poly (styrene-butyl acrylate-acrylononitrile-acrylic acid).

12. A process in accordance with claim 1 wherein said magnetite dispersion comprises said acicular magnetite particles dispersed in water, an anionic surfactant and a nonionic surfactant, and wherein when said dispersion possesses an initial pH of from about 6.5 to about 6.8 is acidified to a pH of about 2.2 to about 2.6.

13. A process in accordance with claim 1 wherein said latex comprises submicron resin particles suspended in water in the presence of anionic surfactant, and wherein said latex possesses a pH of about 6.5 to about 7.5, and when said latex is added to said acidified magnetite there results a mixture with a pH of about 5 to about 5.5.

14. A process in accordance with claim 13 wherein the resulting pH provides a positive charge on the magnetite particles of about +40 to about +10 coulombs/$cm^2$.

15. A process in accordance with claim 13 wherein there is added a dispersion of carbon black and a dispersion of wax particles, followed by adjusting with an acid the pH of said magnetite, latex, carbon black and wax blend to a pH of about 2.2 to about 2.6.

16. A process in accordance with claim 1 wherein said carbon black is dispersed in water and an anionic surfactant, and which dispersion possesses a pH of about 6.3 to about 6.8.

17. A process in accordance with claim 1 wherein said acidified dispersion contains acicular magnetite in an amount of from about 22 to about 35 percent by weight of toner, and wherein in the presence of said anionic latex said magnetite is positively charged.

18. A process in accordance with claim 1 wherein said acicular magnetite is present in an amount of from about 23 to about 32 percent by weight of toner, and wherein in the presence of an acidic environment of about 1.8 to about 3.5 said magnetite possesses a positive charge of about +45 to about +25 coulombs/$cm^2$, and wherein said magnetite also functions as a positive charging coagulant.

19. A process in accordance with claim 1 wherein said acicular magnetite exhibits a coercivity of from about 250 to about 700 Oe.

20. A process in accordance with claim 1 wherein said acicular magnetite particles possess a particle size of about 0.6 micron in length by about 0.1 micron in diameter, and which magnetite is comprised of about 21 percent FeO and about 79 percent $Fe_2O_3$.

21. A process in accordance with claim 1 wherein subsequent to heating said toner exhibits a magnetic signal of from about 115 to about 150 percent of the nominal signal.

22. A process in accordance with claim 12 wherein the toner hot offset temperature (HOT) is about 210° C. to about 250° C.

23. A process in accordance with claim 1 wherein subsequent to heating said toner possesses a minimum fix temperature (MFT) of about 170° C. to about 195° C.

24. A process in accordance with claim 1 wherein said magnetite dispersion is obtained by ball milling, attrition, polytroning, homogenizing, or media milling thereby resulting in magnetite particles dispersed in water containing an anionic surfactant.

25. A process in accordance with claim 1 wherein the carbon black dispersion is present in an amount of about 4 to about 8 percent by weight of toner.

26. A process in accordance with claim 1 wherein the latex contains resin particles of from about 0.15 to about 0.3 micron in volume average diameter.

27. A process in accordance with claim 1 wherein said magnetite is of a size of about 0.6 micron to about 0.1 micron, and said carbon black is of a size of about 0.01 to about 0.2 micron in average volume diameter.

28. A process in accordance with claim 1 wherein the latex contains a resin or polymer selected from the group consisting of poly(styrene-alkyl acrylate), poly(styrene-1,3-diene), poly(styrene-alkyl methacrylate), poly(styrene-alkyl acrylate-acrylic acid), poly(styrene-1,3-diene-acrylic acid), poly(styrene-alkyl methacrylate-acrylic acid), poly(alkyl methacrylate-alkyl acrylate), poly(alkyl methacrylate-aryl acrylate), poly(aryl methacrylate-alkyl acrylate), poly(alkyl methacrylate-acrylic acid), poly(styrene-alkyl acrylate-acrylonitrile-acrylic acid), poly(styrene-1,3-diene-acrylonitrile-acrylic acid), and poly(alkyl acrylate-acrylonitrile-acrylic acid).

29. A process in accordance with claim 1 wherein the magnetite dispersion comprises acicular magnetite pigment particles, water, and an anionic surfactant, and which dispersion functions as a coagulant.

30. A process in accordance with claim 1 wherein said latex contains from about 30 to about 45 percent solids, about 1 to about 2 percent anionic surfactant and water; magnetite dispersion contains from about 25 to about 40 percent magnetite, about 1 to about 2 percent anionic surfactant and water; and wherein said toner subsequent to heating contains about 25 to about 45 percent magnetite, about 4 to about 15 percent carbon black, about 7 to about 9 percent wax, and resin, and wherein the total of said components is about 100 percent.

31. A process in accordance with claim 30 wherein said resin is comprised of styrene-butylacrylate-beta CEA in the ratio of 73.5:26.5:3 pph, respectively.

32. A process in accordance with claim 1 wherein said mixture is first heated below about the glass transition temperature (Tg) of resin contained in said latex, followed by heating above said resin Tg.

33. A process in accordance with claim 32 wherein said acidified magnetite dispersion possesses a low pH of from about 1 to about 3; said anionic latex is at a pH of from about 6 to about 8; and said carbon black and said wax dispersion is at a pH of from about 6 to about 8.

34. A process in accordance with claim 1 wherein said magnetite dispersion is at a pH of about 2.

35. A process in accordance with claim 1 wherein said latex, carbon black and wax dispersion are of a pH of from about 6 to about 8.

36. A process in accordance with claim 35 wherein said pH is about 7, or a substantially neutral pH.

37. A toner obtained by the process of claim 1.

38. A toner process comprising heating a mixture of an acicular magnetite dispersion, a carbon black dispersion, and a latex dispersion, and wherein said magnetite dispersion possesses a low pH.

39. A toner process comprising heating an acidified dispersion of an acicular magnetite with an anionic latex, an anionic carbon dispersion, and optionally an anionic wax dispersion.

* * * * *